United States Patent [19]

Keeler

[11] 3,944,280

[45] Mar. 16, 1976

[54] STACKABLE CHAIR

[75] Inventor: Robert A. Keeler, Grand Rapids, Mich.

[73] Assignee: Steelcase Inc., Grand Rapids, Mich.

[22] Filed: Dec. 27, 1974

[21] Appl. No.: 536,717

[52] U.S. Cl. ..... 297/239; 297/295; 297/457

[51] Int. Cl.[2] ..... A47C 3/04

[58] Field of Search ..... 297/239, DIG. 2, 457, 295, 297/294

[56] References Cited

UNITED STATES PATENTS

| | | | |
|---|---|---|---|
| 2,936,826 | 5/1960 | Reineman | 297/239 X |
| 3,459,449 | 8/1969 | Klausen | 297/239 |
| 3,561,818 | 2/1971 | Lohmeyer | 297/239 |
| 3,822,078 | 7/1974 | Spadolini | 297/DIG. 2 |

*Primary Examiner*—Francis K. Zugel

*Attorney, Agent, or Firm*—Price, Heneveld, Huizenga & Cooper

[57] ABSTRACT

The specification discloses a one-piece, integrally molded plastic chair having a front apron which extends downwardly to the floor along the front and sides of the chair and is connected to the seat along its front edge and along its side edges for only a portion of the distance toward the rear of the chair whereby there is an open space between the side portions of the apron and the rear portions of the seat to give the chair fore and aft comfort flexibility and whereby the rear of the chair is open to allow fore and aft stackability. The apron is shaped to define foot room so that it does not get scuffed by a user.

4 Claims, 6 Drawing Figures

1
10
11
13
20
21
30
31
32
33
34
10'

STACKABLE CHAIR

BACKGROUND OF THE INVENTION

The present invention relates to one-piece, integrally molded plastic stacking chairs. By being molded in one piece of plastic, such chairs are relatively inexpensive and are relatively easy to care for.

Such chairs have been designed to facilitate vertical stacking by nesting one chair on the top of another. They have also been designed to facilitate ganging. These features increase the useability of the chair.

One problem with such prior art chairs is that they tend to be uncomfortable and feel hard when sat upon. Another problem is that they tend to lack lateral stability, i.e., it is difficult to prevent them from wobbling from side to side. Finally, they are typically not very desirable in appearance.

One example is the chair disclosed in U.S. Pat. No. D218,559 issued on Sept. 1, 1970, to M. F. Harty et al and entitled CHAIR. While the chair is reasonably attractive in side view, the large gap in the front of the chair to allow foot room underneath the seat makes the chair rather unattractive in front elevation. Further, the open front renders the chair less stable in a lateral direction. An attempt is made to overcome this in U.S. Pat. No. D218,559 by means of inwardly protruding legs at the rear of the chair. Finally, there is little give in the plastic skirts which extend along the side edges of the seat, thereby rendering the chair rather unyielding when one sits in it.

There has been a need in the art for a one-piece, integrally molded plastic stacking chair which not only is stackable and gangable, but which also is comfortable, laterally stable, and has a reasonably attractive appearance.

SUMMARY OF THE INVENTION

The present invention comprises an integrally molded, one-piece plastic stacking chair which achieves these long-desired goals by a unique construction which results in a chair which is stackable in a fore and aft direction rather than in a vertical direction as is conventional. The plastic stacking chair of the present invention has an integrally molded apron extending generally from the seat to the floor around the front of the chair and sweeping rearwardly toward the rear of the chair. The solid front apron provides firm, lateral stability and the rearwardly extending side portions of the apron support the chair at its rear. This apron is joined to the seat along its front edge and along the seat side edge only for a portion of the distance rearwardly toward the rear of the chair. This leaves an open space between the rear portions of the seat and the apron to give the chair fore and aft flexibility, thereby rendering the chair more yielding and comfortable when one sits in it. Also, it leaves the rear of the chair open, thereby facilitating the fore and aft stacking ability referred to above.

Preferably, the apron is shaped to allow some foot room underneath the front portion of the seat so that the apron does not get scuffed. One particularly desirable manner to achieve this is to create a scooped portion on either side of the relatively narrow, front middle section of the apron. The apron also preferably includes outwardly flared flanges along its rear edge to further increase the stability of the chair and provide ganging ability.

These and other features, objects, and advantages of the invention will be more fully appreciated and understood by reference to the written specification and appended drawings.

DESCRIPTION OF THE PREFERRED EMBODIMENT

Figures 1, 2, 3:
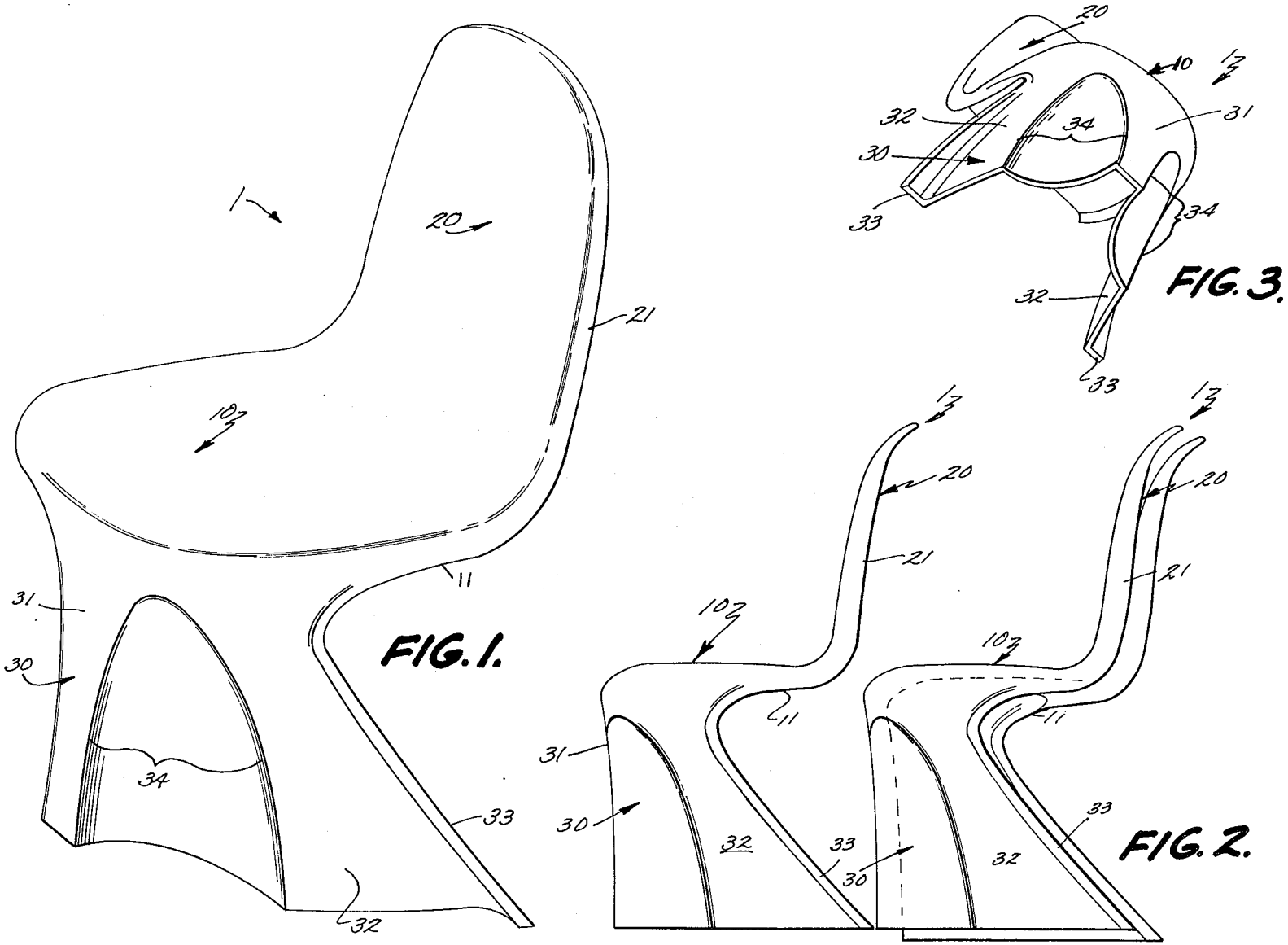
FIG. 1 is a perspective view of a chair of the present invention.
FIG. 2 is a side elevational view of several of the chairs illustrating the manner in which they stack together.
FIG. 3 is a perspective view of the chair taken generally from the bottom thereof.

In the preferred embodiment, the chair 1 is integrally molded in one piece of plastic (FIGS. 1–3). It includes a seat 10, a back 20, and an apron, or skirt, 30 joined to the seat and extending generally continuously to the floor, around the front of the chair, and sweeping rearwardly toward the rear of the chair. The generally continuous front face 31 of apron 30 provides the chair with lateral stability while the rearwardly sweeping sides 32 of the apron further add to lateral stability and extend rearwardly a sufficient distance to provide a support for the chair at its rear.

Apron 30 joins seat 10 at its front edge and extends along that edge around the front corners of seat 10 and rearwardly for only a portion of the distance from the front of seat 10 towards the rear. Even though the side portions 32 of apron 30 extend rearwardly to a point well behind the rearwardmost point of seat 10, the fact that side portions 32 are connected to seat 10 for only a portion of the distance along its side edges leaves a gap or opening between the rear portions of seat 10 and the rearwardly extending portions of sides 32 of apron 30. This gap or opening gives seat 10 and back 20 some flexibility in a fore and aft direction. The result is a chair which yields slightly when a person sits in it. The feeling is considerably more comfortable than would be the case if the side portions 32 of apron 30 were joined to the side edges of seat 10 completely to the rear thereof.

The size of the gap or opening left between the edge of seat 10 and the rearward portions of side 32 of apron 30 will vary depending on a number of factors. These include the type of plastic used and its thickness. A number of different types of plastic are well known in the art for use in molding chairs, including high impact polystyrene high impact foamed polystyrene, polypropylene, high impact foamed polypropylene, polyethylene, ABS and glass reinforced polyesters.

Apron 30 does not wrap around to close in the rear of chair 1. Rather, the rear of chair 1 below seat 10 is open, thereby facilitating stacking of chair 1 with others like it by moving them together in a fore and aft movement. FIG. 2 in particular illustrates the fore/aft ganging nature of this chair.

The chair is given further lateral stability by a rear flange 33 which flares laterally outwardly along the rear edge of each side portion 32 of apron 30. Flange 33 extends generally at a right angle to the side portions 32 of apron 30. It extends outwardly a sufficient distance to increase the lateral stability of the chair and strengthen side portion 32 of apron 30. Naturally, the extent to which flange 33 extends outwardly will depend on a number of factors including the type of plastic used and its thickness. Also, designers may want to vary the width of flange 33 for aesthetic purposes.

Rear flanges 33 also provide a means for ganging like chairs 1 together. The chairs can be aligned adjacent one another and clipped together by means of a channel-shaped clip seated on the floor and opening upwardly for embracing the bottoms of two closely adjacent rear flanges 33 on closely adjacent chairs 1. Other alternatives are available, such as lapping the rear flanges 32 of adjacent chairs and bolting through an aperture provided for ganging purposes. Various other types of clips and connectors can readily be used as will be apparent to those skilled in the art as a result of the provision of laterally extending rear flanges 33.

Each laterally outwardly projecting rear flange 33 extends upwardly and merges with a downwardly extending seat edge flange 11 extending along the side edge of seat 10. Seat edge flange 11 then curves upwardly and merges into a rearwardly extending back edge flange 21 along the edge of back 20. Seat and back edge flanges 11 and 21, respectively, increase the rigidity and strength of seat 10 and back 20.

To allow a person room to slip his feet in under seat 10 without unduly scuffing against and marring the surface of apron 30, a scooped-out portion 34 is provided at each side of the relatively narrow front middle portion 31 of apron 30. Each scooped portion 34 extends rather sharply rearwardly from its juncture with the relatively narrow front portion 31 and then sweeps rearwardly and turns outwardly to a relatively sharp juncture with the side portion 32 of apron 30. Not only does this provide foot room underneath the seat 10 but it also reinforces and rigidifies apron 30 both in the front and at the sides thereof.

The result is a chair which is economical in construction, being integrally molded in one piece of plastic, a chair which can be stacked by nesting the chairs together in a fore and aft direction in contrast to conventional vertical stacking, a chair which can be ganged together with like chairs, a chair which is relatively comfortable due to the fore and aft flexing facilitated by the gap between the rear of seat 10 and the rearwardly extending portions of apron 30, a chair which has lateral stability due to the continuous apron around the front of the chair and due in part to the outwardly flared flanges 33, and a chair which is and can be designed to be a relatively attractive chair.

Figure 6:
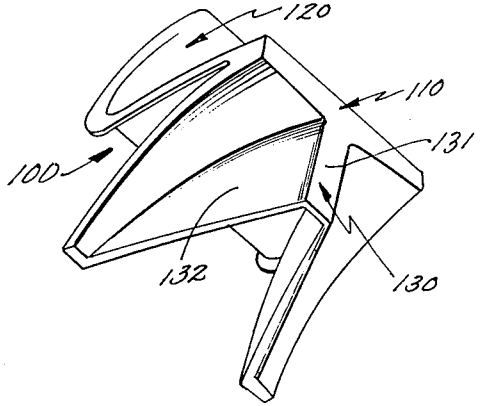
FIG. 6 is a perspective view of the alternative embodiment chair taken generally from the bottom thereof.
Figure 5:
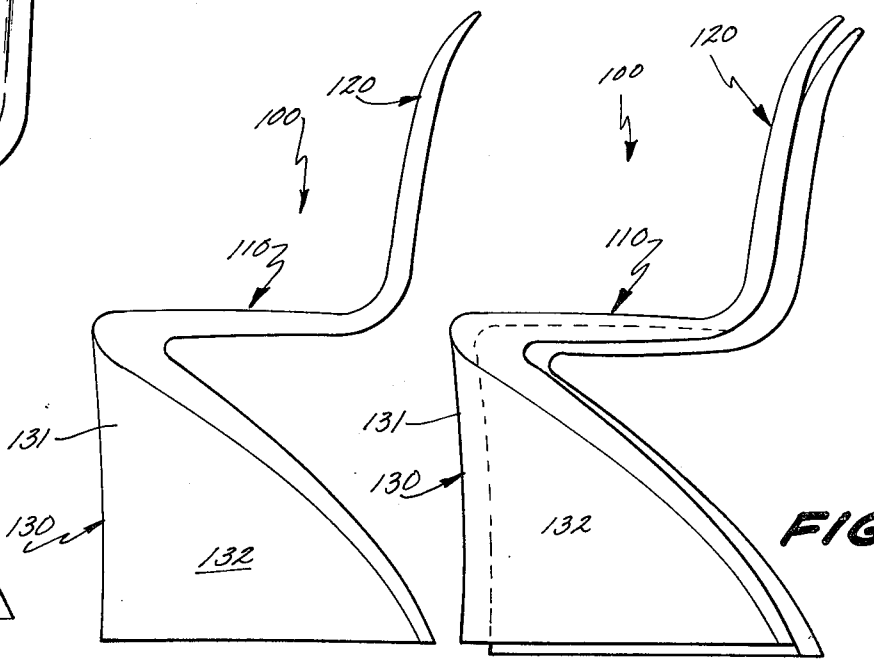
FIG. 5 is a side elevational view of several of the alternative embodiment chairs illustrating the manner in which they stack in a fore and aft direction.
Figure 4:
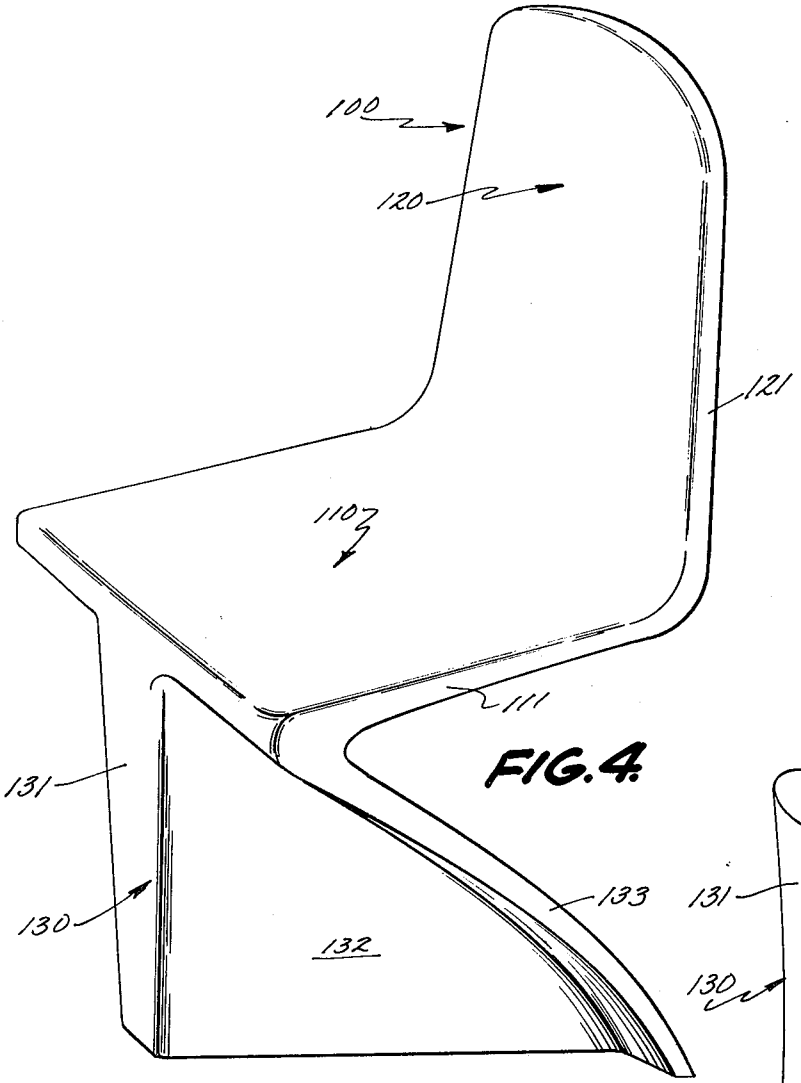
FIG. 4 is a perspective view of an alternative chair embodiment of the invention.

FIGS. 4–6 show an alternative embodiment 100 of the present invention. Chair 100 is integrally molded of one-piece, in plastic, and includes a seat 110, a back 120, and a skirt or apron 130. As with apron 30 of chair 1, apron 130 extends downwardly to the floor and generally continuously around the front of chair 100 and rearwardly to a terminal point disposed generally rearwardly of the rearwardmost portion of seat 110. Skirt 130 is joined to the edge portion of seat 110 along the front edge thereof and for a short portion of the distance along the side edges thereof towards the rear of the chair. As with chair 1, there is a gap between the rearward portions of seat 110 and the rearwardly extending portions of sides 132 of apron 130.

As with apron 30, apron 130 of chair 100 includes a relatively narrow, front middle portion 131. While there are no scoop portions such as scoop portions 34 of apron 30, apron 130 is designed so as to provide foot room under the front portions of seat 110. Specifically, the side portions 132 extend sharply rearwardly from their junction with the relatively narrow front midportion 131. Side portions 132 then join rear flanges 133 which flare sharply outwardly therefrom.

As with chair 1, the rear flanges 133 of chair 100 merge into and join the downwardly extending edge flange 111 on seat 110 which in turn sweeps upwardly and merges with the rearwardly extending edge flange 121 on back 120. The functions of these respective flanges are the same as the functions of their corresponding flanges in chair 1.

Chair 100, like chair 1, is stackable in a fore and aft direction due to the fact that the back of the chair beneath the seat thereof is open. The apron 130 does not wrap around and enclose the rear of the chair.

Accordingly, alternative embodiment chair 100 is also stackable, gangable, durable, economical, comfortable, and laterally stable. Of course, it will be understood that other embodiments of the present invention can be made without departing from the spirit or broader aspects of the invention.

The embodiments of the invention in which an exclusive property or privilege is claimed are defined as follows:

1. A chair comprising: a one-piece, integrally molded, plastic seat, back, and supporting apron; said apron extending from said seat generally continuously to the floor and extending generally continuously across the front of the chair to define a front portion and towards the rear of the chair on each side of the chair to define side portions, to a point at floor-engaging level located sufficiently rearwardly to provide support at the rear of the chair for a person seated on the chair; said apron joining said seat along the front edge of said seat and along only a portion of the side edges of said seat for only a portion of the distance toward the rear of said chair whereby an opening is provided between the rear portions of said seat and the rearwardly extending side portions of said apron to give the chair comfort yielding flexibility in a fore and aft direction; said apron terminating along the sides of said chair so as to leave the rear of said chair open beneath said seat whereby said chair can be stacked with others of its kind in a generally fore and aft direction; said front portion of said apron comprising a relatively narrow front mid-portion located at the front, center of said chair extending from the bottom edge of the apron upwardly generally to said seat; said side portions of said apron including a rearwardly and outwardly flaring surface at each side of said mid-portion extending from the bottom edge of the apron upwardly a substantial distance toward said seat, said flaring surface sweeping sharply rearwardly from said narrow front mid-portion and then outwardly to leave exposed floor surface under said seat on either side of said front mid-portion while still providing lateral stability at the rear of the chair.

2. The chair of claim 1 in which said rearwardly and outwardly sweeping surfaces of said apron define scooped portions in said apron generally at the juncture of said front portion and said rearwardly extending side portions of said apron, said scooped portions providing foot room beneath the front portions of said seat.

3. The chair of claim 2 which includes a rear flange extending generally laterally outwardly from the rear edge of each said rearwardly extending side portion of said apron and extending from the bottom edge of said apron a substantial distance toward said seat to thereby increase the lateral stability of said chair and increase the strength and ridgidity of said apron.

4. The chair of claim 1 in which said outwardly flaring portion of each said flaring surface of said apron flares sharply and generally laterally outwardly from said rearwardly sweeping portion of said flaring surface of said apron to define a rear flange along the rear edge of said apron and extending from the bottom edge of said apron a substantial distance toward said seat giving said chair increased lateral stability, and rigidifying and strengthening said apron.

* * * * *